US007533871B1

(12) United States Patent
Everett et al.

(10) Patent No.: US 7,533,871 B1
(45) Date of Patent: May 19, 2009

(54) ROPE CONTROL APPARATUS

(76) Inventors: Perry L. Everett, 5700 Willow La., Lake Oswego, OR (US) 97035; Richard C. Everett, 5700 Willow La., Lake Oswego, OR (US) 97035; Thayne J. Golden, 11605 SW. Willow La., Beaverton, OR (US) 97005

( * ) Notice: Subject to any disclaimer, the term of this patent is extended or adjusted under 35 U.S.C. 154(b) by 0 days.

(21) Appl. No.: 11/983,391

(22) Filed: Nov. 9, 2007

Related U.S. Application Data

(60) Provisional application No. 60/857,136, filed on Nov. 7, 2006.

(51) Int. Cl.
*B66D 3/04* (2006.01)

(52) U.S. Cl. ..... 254/408; 254/405; 188/65.4; 188/65.3; 188/65.5; 182/5; 182/193

(58) Field of Classification Search ..... 254/393, 254/394, 395, 396, 405, 408; 188/65.1, 65.2, 188/65.3, 65.4, 65.5, 64; 182/193, 5
See application file for complete search history.

(56) References Cited

U.S. PATENT DOCUMENTS

| | | | | | |
|---|---|---|---|---|---|
| 1,381,311 | A * | 6/1921 | Johnson et al. | ..... | 24/134 R |
| 2,330,736 | A * | 9/1943 | Paulson | ..... | 24/132 R |
| 2,976,955 | A * | 3/1961 | Huber | ..... | 188/65.1 |
| 3,814,210 | A * | 6/1974 | Hoffman | ..... | 182/6 |
| 3,824,653 | A * | 7/1974 | Sholler | ..... | 24/134 KB |
| 3,863,893 | A * | 2/1975 | Cavalieri | ..... | 254/384 |
| 3,967,349 | A * | 7/1976 | Christensen | ..... | 24/134 KB |
| 4,217,847 | A * | 8/1980 | McCloud | ..... | 114/218 |
| 4,480,816 | A * | 11/1984 | Gortan | ..... | 254/264 |
| 4,483,517 | A * | 11/1984 | Cavalieri | ..... | 254/254 |
| 4,669,582 | A * | 6/1987 | Sandreid | ..... | 188/65.1 |
| 4,716,630 | A * | 1/1988 | Skyba | ..... | 21/134 R |
| 5,054,577 | A * | 10/1991 | Petzl et al. | ..... | 182/5 |
| 5,076,400 | A * | 12/1991 | Petzl et al. | ..... | 188/65.5 |
| 5,083,350 | A * | 1/1992 | Sandreid | ..... | 24/134 R |
| 5,544,723 | A * | 8/1996 | Gettemy | ..... | 188/65.4 |
| 5,850,893 | A * | 12/1998 | Hede et al. | ..... | 182/193 |
| 5,921,353 | A * | 7/1999 | Day | ..... | 188/65.4 |
| 5,954,153 | A * | 9/1999 | Rogelja | ..... | 182/5 |
| 6,029,777 | A * | 2/2000 | Rogelja | ..... | 182/193 |
| 6,155,384 | A * | 12/2000 | Paglioli | ..... | 188/65.2 |
| 6,378,650 | B2 * | 4/2002 | Mauthner | ..... | 182/5 |
| 6,446,753 | B1 * | 9/2002 | Novak | ..... | 182/193 |
| 6,732,833 | B2 * | 5/2004 | Rogelja | ..... | 182/5 |

* cited by examiner

*Primary Examiner*—Emmanuel M Marcelo
(74) *Attorney, Agent, or Firm*—Edward E. Roberts

(57) ABSTRACT

Embodiments of the invention provide a simple and convenient way to ascend and descend a rope without using a belayer. Embodiments of the invention can smoothly transition from a rope clamping position to a rope unclamping position, conveniently providing an effective rope control device.

4 Claims, 8 Drawing Sheets

Fig. 3A
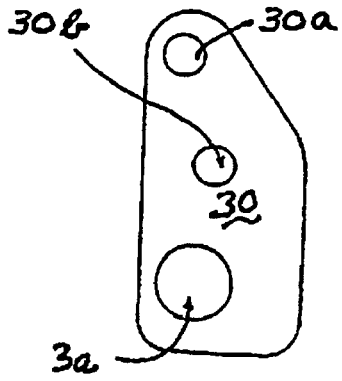
Fig. 3B
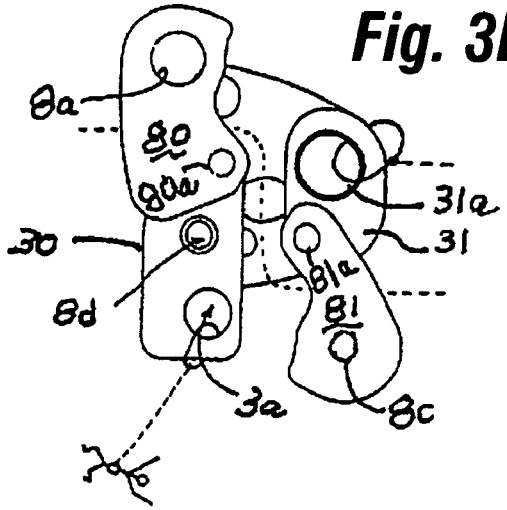
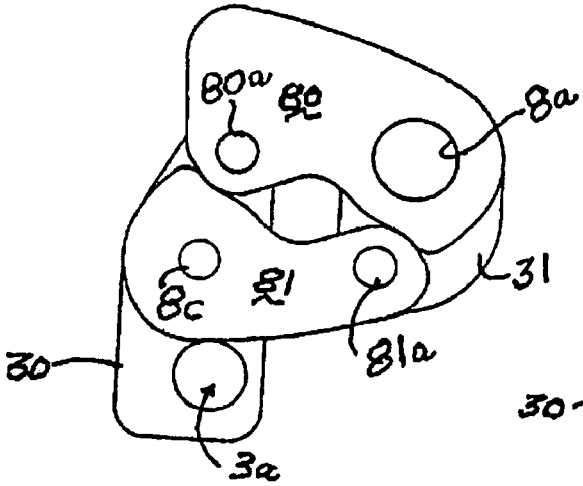
Fig. 3C
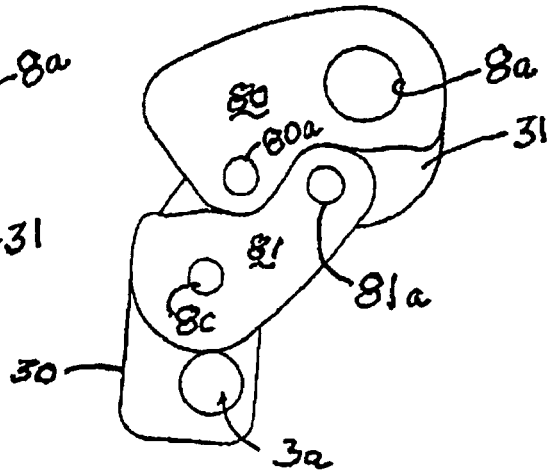
Fig. 3D

Fig. 4A
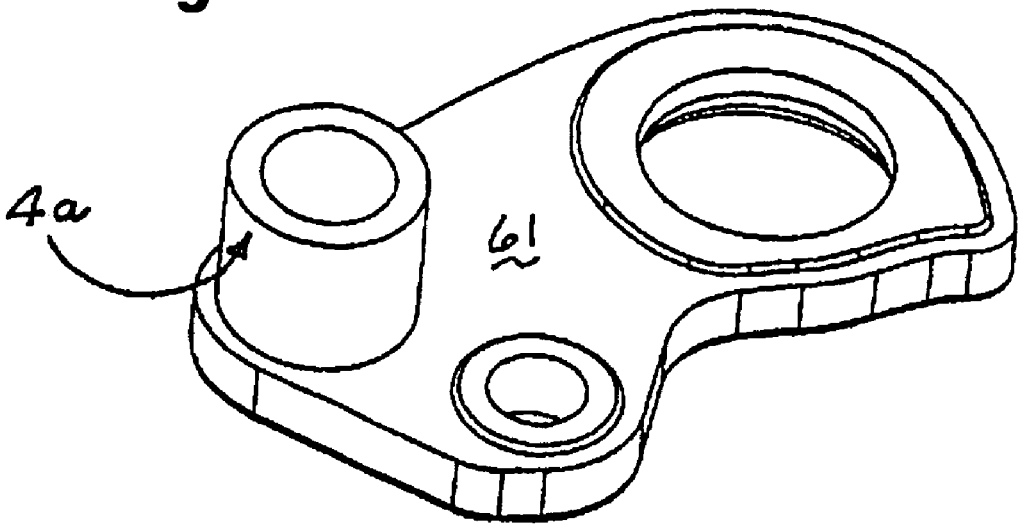
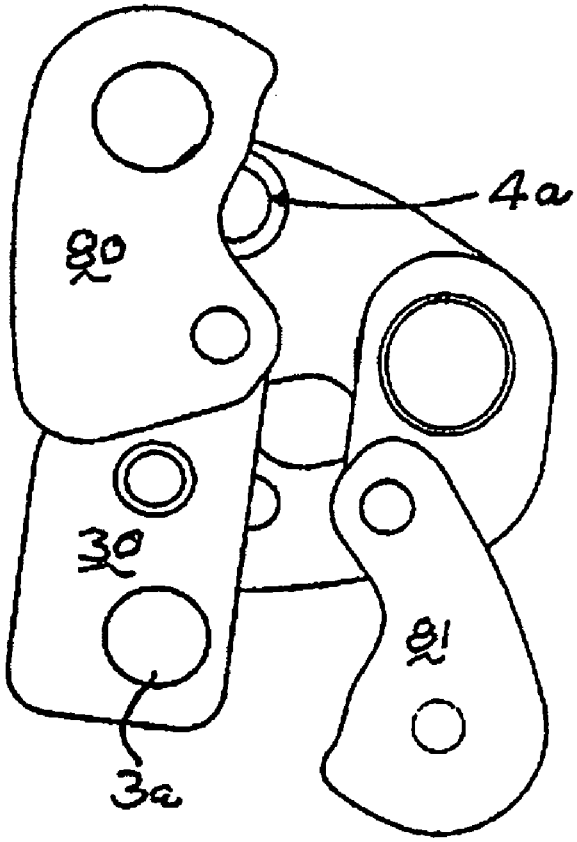
Fig. 4B

ROPE CONTROL APPARATUS

CLAIM FOR BENEFIT OF EARLIER FILING DATE

The present utility application claims the benefit of U.S. Provisional Application No. 60/857,136 filed on 7 Nov. 2006 and entitled "ROPE CONTROL APPARATUS". The present utility application has the same inventors, subject matter and title as the aforesaid Provisional Application.

BACKGROUND

The background of the invention will be discussed in two parts.

1. Field of the Invention

The present invention relates to rope control devices, and more particularly, to an apparatus for ascending and descending a rope without the assistance of a belayer.

2. Related Art

In U.S. Pat. No. 6,899,203 to Golden et al. there is shown and described embodiments to provide a simple and convenient way to ascend and descend a rope without using a belayer wherein there is a smooth transition from a rope clamping position to a rope unclamping position, thus conveniently providing an effective rope climbing device.

SUMMARY

Embodiments of the present invention relate to the disclosure of U.S. Pat. No. 6,899,203 issued on 31 May 2005 to Golden et al., which patent is incorporated herein by reference. The inventors of the present invention are the same as those of U.S. Pat. No. 6,899,203. The present invention provides a more controlled release of the rope during descent.

DRAWINGS

FIG. 1 is an exploded perspective diagram illustrating the manner in which the components of the rope management device of U.S. Pat. No. 6,899,203 are assembled in relationship to each other;

FIGS. 3A-3D illustrate a user attachment point according to an embodiment of the invention;

FIGS. 4A and 4B illustrate an ascender aid according to an embodiment of the invention;

DESCRIPTION

The present invention provides a different embodiment of the disclosure of U.S. Pat. No. 6,899,203 issued on 31 May 2005 to Golden et al., which patent is incorporated herein by reference. This embodiment provides a more controlled release during operation of the rope control apparatus.

Figure 1:
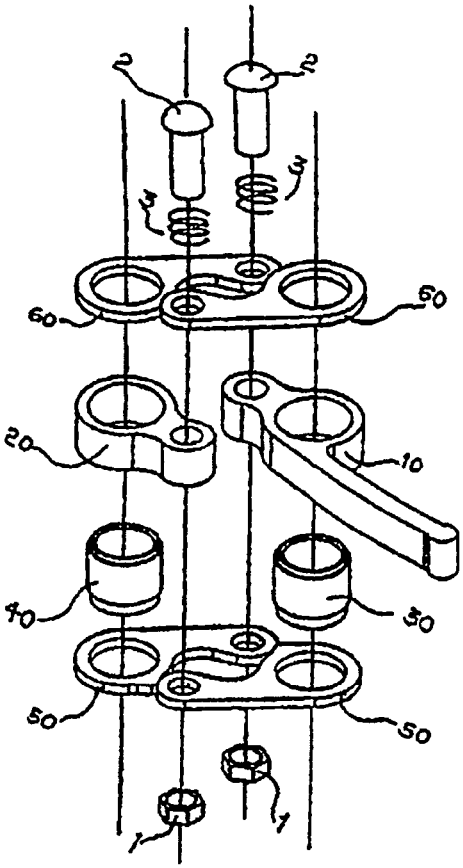
Fig. 1 Prior Art

FIG. 1 is an exploded diagram illustrating the manner in which the components of the prior art rope management device of U.S. Pat. No. 6,899,203 are assembled in relationship to each other.

Figure 2:
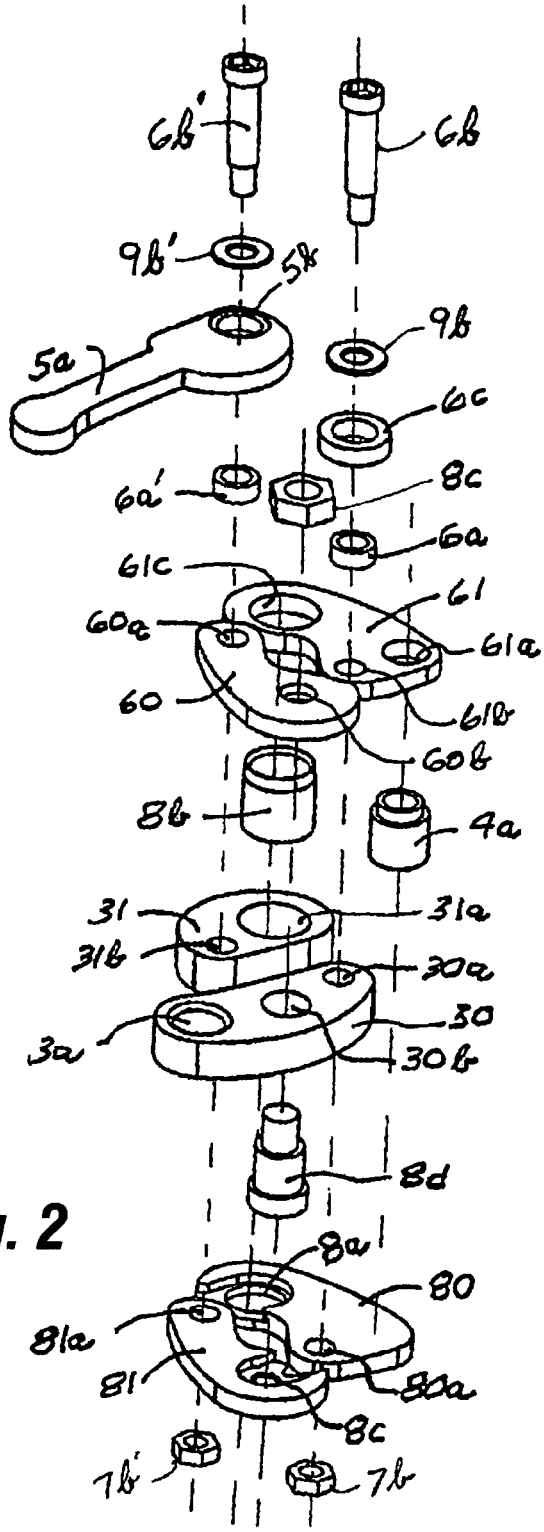
FIG. 2 is an exploded diagram illustrating how the components of the present invention are assembled in relationship to each other according to an embodiment of the invention.

FIG. 2 is an exploded diagram illustrating the manner in which components of the present invention are assembled in relationship to each other in accordance with the present invention. As illustrated, the major components include upper brake 30, lower brake 31, sideplates 60, 61, 80 and 81, handle 5*a*, bushing 4*a*, 6*a* and 8*b*, roller disc 6*c*, bolt 8*d* with push pin 9*b*, locknuts 7*b*, 7*b*' and 8*c*, washers 9*b* and 9*b*' and connective bolts 6*b* and 6*b*'.

As indicated in FIG. 2 the components of the invention are variously assembled as follows:

a first brake 30 has a first pivot hole 30*a*, a second pivot hole 30*b*, and an attachment hole 3*a* configured to be linked to an end of a rope;

a second brake 31 having a third pivot hole 31*a* and a fourth pivot hole 31*b;* a first sideplate 80 rotatably affixed at fifth hole 80*a* to a first side of the brake 30 at the first pivot hole 30*a* by means of bolt 6*b* and rotatably affixed at 8*a* to a first side of the brake 31 at a third pivot hole 31*a* by means of bushing 8*b;* a second sideplate 81 rotatably affixed at a sixth hole 81*a* to a first side of the brake 31 at the fourth pivot hole 31*b* and rotatably affixed at 8*c* to a first side of the brake 30 at the second pivot hole 30*b* by means of bolt/pin 8*d;* a third sideplate 60 rotatably affixed at seventh hole 60*a* to a second side of brake 31 at the fourth hole 31*b* by means of bolt 6*b*' and to a second side of brake 30 at second hole 30*b* by means of bolt 8*d*, bolt 8*d* continuing on through eighth hole 60*b* of third sideplate 60 to terminate with lockwasher 8*c;* a fourth sideplate 61 rotatably affixed at ninth hole 61*b* to the second side of the brake 30 at the first hole 30*a* by means of bolt 6*b* and rotatably affixed tenth hole 61*c* by means of a portion of bolt 8*d* to the second side of the brake 31 at the third hole 31*a;* roller disc 6*c* connected by means of bolt 6*b* through washer 9*b* and hole 61*b;* handle 5*a* connected by means of bolt 6*b*' through washer 9*b*' and hole 5*b* to seventh hole 60*a* of sideplate 60 and positioned to cam off roller disc 6*c*; and bushing 4*a*, which aids in the ascent mode when the operator is pulling a rope through the apparatus of the invention, is positioned between sideplates 61 and 80 and connected at eleventh hole 61*a* to sideplate 61.

Bolt 8*d* has push pin 9*b* connected and positioned to aid in providing braking pressure to the rope.

FIGS. 3A-3E are plan view diagrams illustrating various components of the rope control device according to the present invention. It is to be noted that the configurations of the components may be somewhat different in the various views, however, the function of the component is as described. FIG. 3A illustrates upper brake 30 having attachment point hole 3*a*, hole 30*b* for receiving bolt 8*d* therethrough, and first pivot hole 30*a*.

FIGS. 3B-3D illustrate attachment point hole 3*a* with various positions of the side plates 80, 81 and 61. FIG. 3B shows the attachment point 3*a* with the apparatus in the full open state with the sideplates 80, 81 in the open view. Indicated in dotted lines is the manner in which the rope passes under sideplates 80 and 81 and between brakes 30 and 31. Also indicated is the user attachment point 3*a*, the user attached by carabiner. A second carabiner attachment point is indicated as attached to sideplate 31 at hole 31*a*. FIG. 3C shows the attachment point 3*a* with the apparatus in the full open position with the sideplates 80, 81 in the closed position. FIG. 3D shows the attachment point 3*a* with the apparatus in the full closed position with the sideplates 80, 81 in the closed position.

FIGS. 4A and 4B illustrate ascender aid bushing 4*a*, FIG. 4A showing sideplate 61 having bushing 4*a* connected as described above in a manner to aid in providing easier accent of the user. FIG. 4B illustrates bushing 4*a* with the rope control apparatus in the full open position.

Figure 5A:
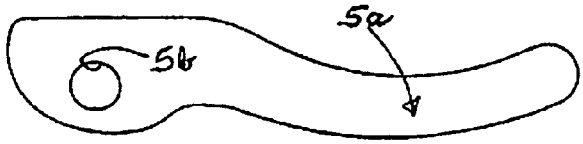
FIGS. 5A-5C illustrate a handle and roller/disc according to an embodiment of the invention.
Figure 5B:
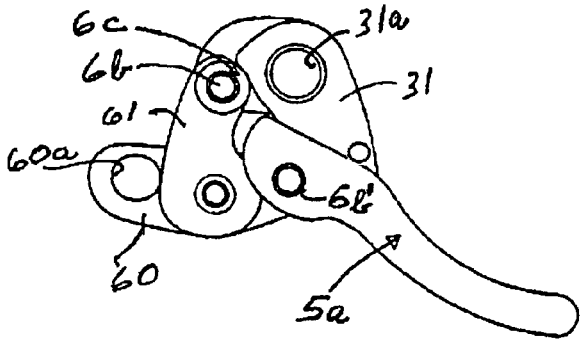
Figure 5C:
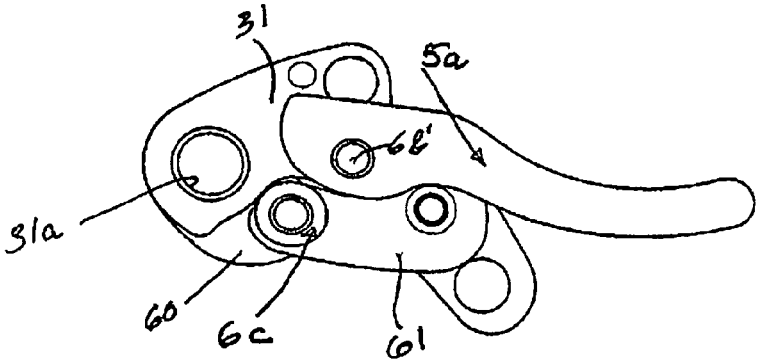

FIGS. 5A-5C illustrates cooperation of the handle 5*a* and the roller/disc 6*c* to cam sideplates 60 and 61. FIG. 5A shows an example configuration of the handle 5*a* with FIG. 5B illustrating handle 5*a* in the full open position and FIG. 5C illustrating handle 5*a* in the full closed position. As shown in FIG. 2 handle 5*a* is attached by a bolt 6*b*' through hole 5*b* of handle 5*a* and through hole 60*a* of sideplate 60, and thence on through hole 31*b* of brake 31 and hole 81*a* of sideplate 81 to terminate in a lock washer. Handle 5*a* is thus able to cam off of the bolt 6*b*' using roller/disc 6*c*, which allows variation of pressure on the rope by brakes 30 and 31 to thereby control the force needed to release bite on the rope. This also allows for varied rope sizes. This arrangement, in combination with the attachment point 3*a* provides for more controlled release when descending.

Figure 6A:
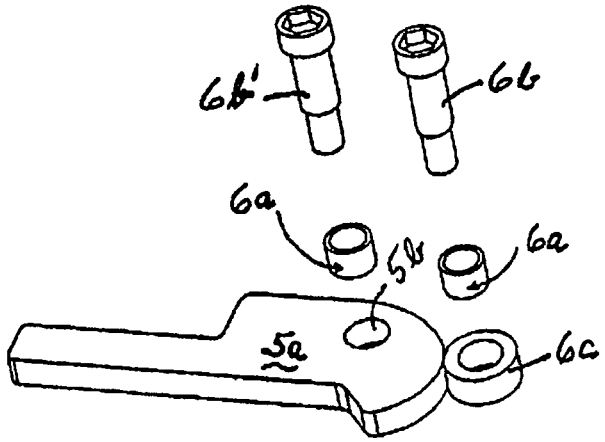
FIGS. 6A-6C illustrates a combination spacer/bearing/bushing according to an embodiment of the invention.
Figure 6B:
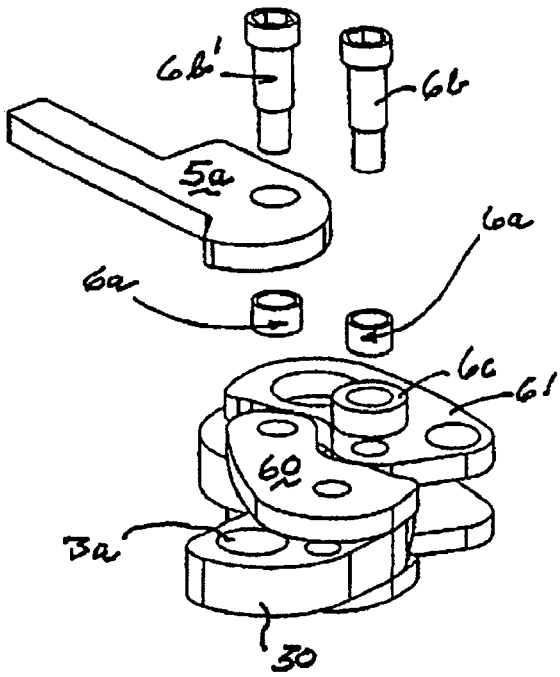
Figure 6C:
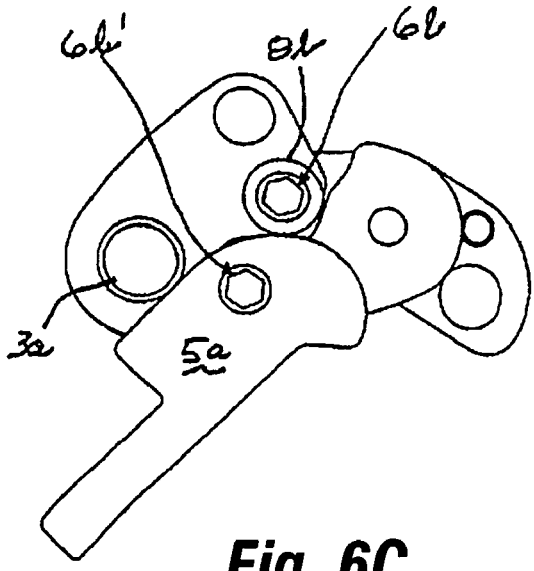

FIGS. 6A-6C illustrate in exploded views (FIGS. 6A and 6B) and in assembled plan view (FIG. 6C) a pair of bushings 6*a* that are spacers and act as bearings both for handle 5*a* and roller/disc 6*c*.

Figure 7A:
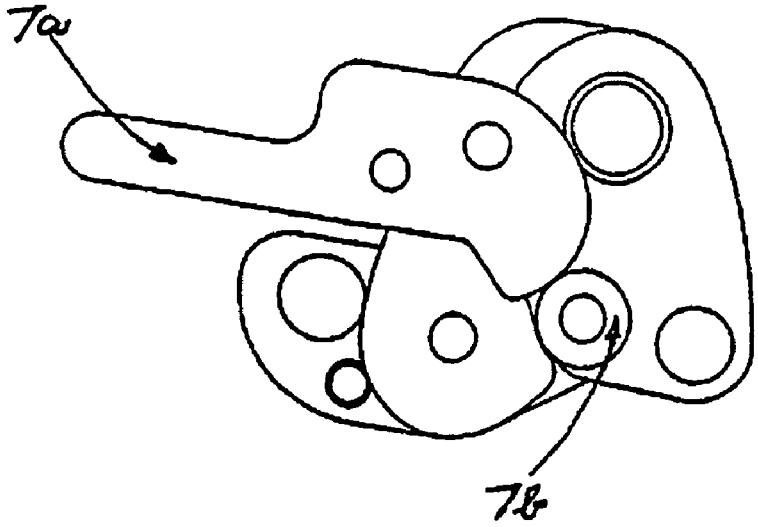
FIGS. 7A and 7B illustrate another handle and roller/disk according to an embodiment of the invention.
Figure 7B:
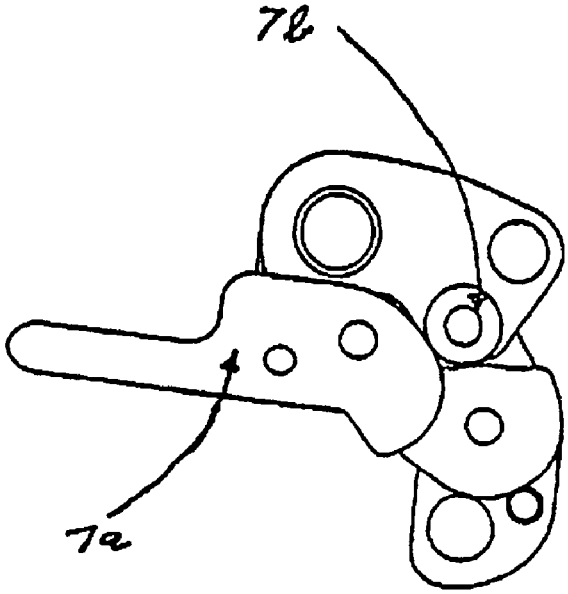

Even though the handle 5*a* of FIGS. 5A-5C is shown in FIG. 2 and described above, FIGS. 7A and 7B is illustrative of a combination handle 7*a* and roller disc 7*b* embodiment that is also exemplary of the present invention. Shown in FIG. 7A with the apparatus of the invention in open view is the handle 7*a* and roller/disk 7*b* positioned and cooperating to cam affixed sideplates. As arranged, the handle 7*a* is able to cam in a manner to increase or decrease bite on a portion of the rope thereby providing controllable force to release clamping force on the rope, and as well handle varied rope sizes. FIG. 7B illustrates the handle 7*a* and roller/disk 7*b* with the apparatus in closed position.

Figure 8A:
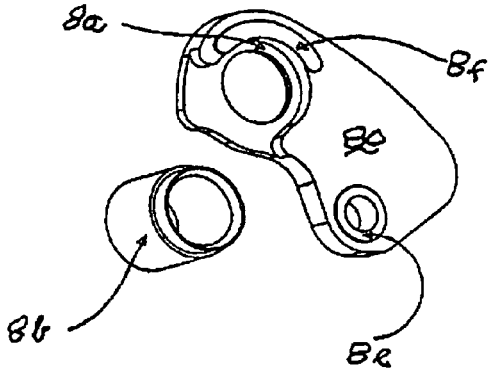
FIGS. 8A-8D illustrate channeled and machined-on washers according to an embodiment of the invention.
Figure 8B:
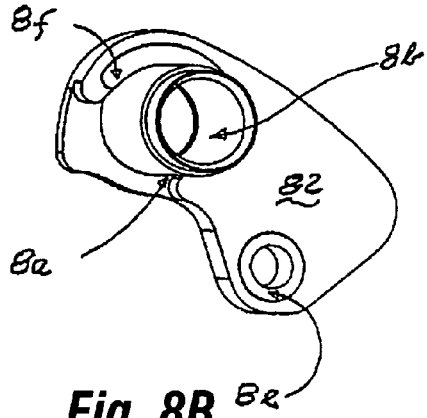
Figure 8C:
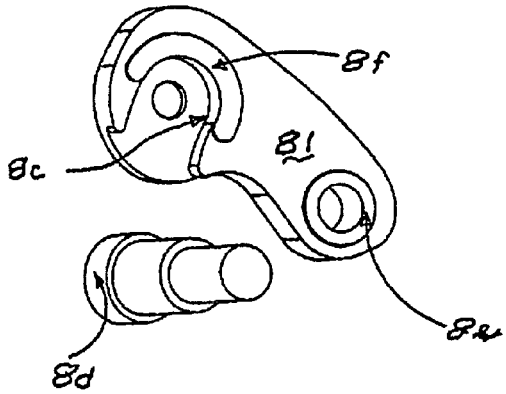
Figure 8D:
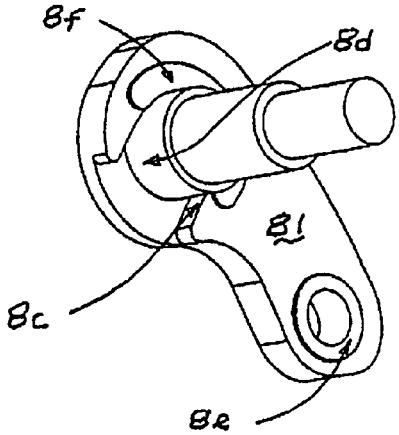

FIGS. 8A-8D illustrate channeled and slotted sideplates with machined on washers. FIG. 8A illustrates sideplate 80 having channel 8*a* for receiving non-attached bushing 8*b* with machined on washers 8*e* and 8*f*. FIG. 8B illustrates captivated bushing 8*b*. FIG. 8C illustrates sideplate 81 having channel 8*c* for receiving non-attached bolt/pin 8*d* and FIG. 8D illustrates attached bolt/pin 8*d*.

Figure 9A:
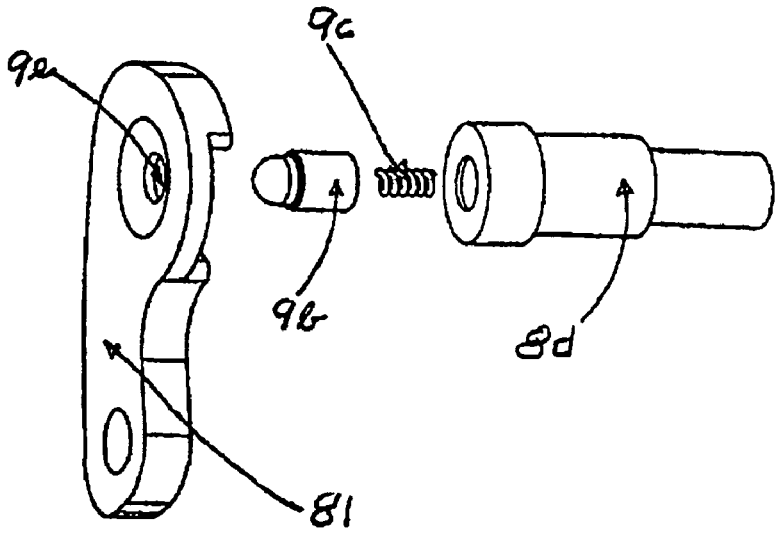
FIGS. 9A and 9B illustrate a bolt and included push pin according to an embodiment of the invention.
Figure 9B:
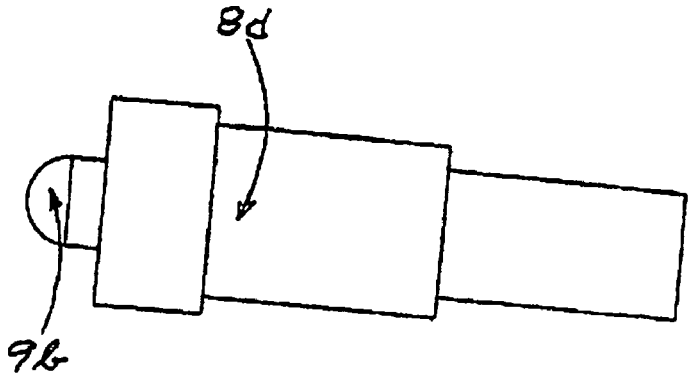

FIGS. 9A and 9B illustrate bolt 8*d* which includes push pin 9*b* and spring 9*c*, FIG. 9A being an exploded view showing assembly of the components and FIG. 9B showing the components assembled. Also shown in FIG. 9A is sideplate 81 having hole 9*e* for admitting push pin 9*a* to protrude therethrough.

Although the present invention has been described with reference to illustrated and described embodiments, other modifications and embodiments can be devised by those skilled in the art that that would fall within the spirit and scope of the invention.

What is claimed is:

1. Rope control apparatus comprising a first brake having a first pivot hole, a second pivot hole, and an attachment hole configured to be linked to an end of a rope;

a second brake having a third pivot hole and a fourth pivot hole;

a first sideplate rotatably affixed at a fifth hole to a first side of said first brake at the first pivot hole by means of a first bolt and rotatably affixed to a first side of said second brake at a third pivot hole by means of a first bushing;

a second sideplate rotatably affixed at a sixth hole to a first side of said second brake at a fourth pivot hole and rotatably affixed to a first side of said first brake at the second pivot hole by means of a second bolt;

a third sideplate rotatably affixed at the seventh hole to a second side of said second brake at a fourth hole by means of a third bolt and to a second side of said first brake at the second hole by means of said second bolt continuing on through the eighth hole of said third sideplate to terminate with a first lockwasher;

a fourth sideplate rotatably affixed at a ninth hole to the second side of said first brake at the first hole by means of first bolt and rotatably affixed to a tenth hole by means of said second bolt to the second side of said second brake at the third hole;

a roller disc connected by means of said first bolt through a second washer and through said ninth hole;

a handle connected by means of said third bolt through a first washer to a seventh hole of said third sideplate and positioned on said fourth sideplate to cam off said roller disc; and a bushing positioned between said first and fourth sideplates connected at the eleventh hole of said fourth sideplate.

2. The rope control apparatus of claim 1 wherein said second bushing aids in the ascent mode when the operator is pulling a rope through the apparatus of the invention.

3. The rope control apparatus of claim 1 configured to control a load that is linked to said first brake by operating on a portion of the rope that is aligned between said first brake and said second brake.

4. The rope control apparatus of claim 1 configured to perform a self-advancing function.

* * * * *